United States Patent [19]

Mollman et al.

[11] Patent Number: 4,458,815

[45] Date of Patent: Jul. 10, 1984

[54] CANDY TRAY

[75] Inventors: Robert E. Mollman, Chagrin Falls, Ohio; Charles E. Kappelt, Linesville, Pa.

[73] Assignee: Molded Fiber Glass Tray Company, Linesville, Pa.

[21] Appl. No.: 355,319

[22] Filed: Mar. 8, 1982

[51] Int. Cl.[3] ..... B65D 21/02

[52] U.S. Cl. ..... 206/511; 34/237; 211/126

[58] Field of Search ..... 34/237, 238; 206/503, 206/509, 511, 512, 557; 211/126, 131; 414/611, 618, 619, 621, 622, 623, 679

[56] References Cited

U.S. PATENT DOCUMENTS

| | | | |
|---|---|---|---|
| 241,754 | 5/1881 | Thomas | 34/238 |
| 425,816 | 4/1880 | Moulton | 34/238 |
| 1,011,971 | 12/1911 | Kukkuck | 34/238 |
| 1,678,443 | 7/1928 | Proctor et al. | 34/238 |
| 1,829,489 | 10/1931 | Abbe | 414/622 |
| 2,496,093 | 1/1950 | Iwata | 206/509 |
| 2,822,106 | 2/1958 | Fabian et al. | 206/511 |
| 3,416,704 | 12/1968 | Frater | 206/509 |
| 3,481,502 | 12/1969 | Slayman | 206/511 |
| 3,648,849 | 3/1972 | Harris et al. | 206/503 |
| 3,934,789 | 1/1976 | Allman et al. | 34/238 |
| 4,000,704 | 1/1977 | Griffin, Jr. | 206/511 |
| 4,050,580 | 9/1977 | Wilson | 206/511 |
| 4,120,444 | 10/1978 | Gray | 206/511 |

FOREIGN PATENT DOCUMENTS

| | | | |
|---|---|---|---|
| 0846674 | 6/1952 | Fed. Rep. of Germany | 414/619 |
| 2645987 | 3/1977 | Fed. Rep. of Germany | 206/509 |
| 0548771 | 10/1957 | Italy | 414/621 |
| 0341436 | 11/1959 | Switzerland | 414/622 |
| 1063347 | 3/1967 | United Kingdom | 206/509 |

*Primary Examiner*—George E. Lowrance
*Assistant Examiner*—Jimmy G. Foster
*Attorney, Agent, or Firm*—Charles L. Lovercheck; Wayne L. Lovercheck; Dale R. Lovercheck

[57] ABSTRACT

A tray is disclosed especially suitable for use in the candy industry. The tray has a unique arrangement of legs, lugs, and anti-slip features which facilitate stacking, handling, and cleaning of the trays.

4 Claims, 6 Drawing Figures

CANDY TRAY

GENERAL DESCRIPTION OF INVENTION

A tray suitable for candy starch is made from molded fiber glass having a gripper lug system which prevents the tray from slipping out of position as it is being handled by automatic machinery. The amount of material required to create the lugs is minimum but consistent with good lug strength and proportions. The lugs do not significantly interfere with manual handling of the trays and prevent slipping with a factor of safety beyond the point where the center of gravity of the tray is beyond the support afforded by the mechanical lift hand. The lugs are spaced sufficiently to forgive machine inaccuracies and thus not interfere with mechanical handling devices and the exact spacing of the configuration of the lugs is not highly critical to suit the function. The angle and spacing of the lugs relates to the length of the tray. The function is accomplished by integrally molded configuration of lugs on the underside of the tray at the gripper area between which the gripper hand movement is restricted and because of which no significant compromise exists during manual handling. The trays are resistant to slipping out of position in the presence of vibration after stacking and the lug design provides more resistance to slipping than simple narrowed or roughened stacking surfaces and are more forgiving of initial misalignment than other mechanical locking systems. The tray is compatible to be stacked with trays normally used in the candy industry. The spacing of the ribs relates to the length of the ribs on their angle to the tray side.

The trays clean easily and can be run through heated pressure washers, have no sharp corners to hold starch, no seams to trap moisture or material. While seamless trays are not per se new, in the instant combination the seamless feature contributes to the effectiveness of the overall combination for its intended purpose. They are quick drying, are more rigid than conventional trays and can be inter-stacked with existing wooden starch trays. Are compatible with most popular machines and stackers. Drying time can be reduced because the trays won't absorb moisture; elevated temperatures are no problem as they withstand temperatures over 250° F. Rotting, splinters, warping, and cracking are eliminated. The trays hold constant dimension which prevents jamming in the machine, reducing down time. The trays are long lasting, rarely are damaged even in a bad jam.

REFERENCE TO PRIOR ART

Applicant knows of no relevant prior art in connection with the above trays.

OBJECTS OF THE INVENTION

It is an object of the invention to provide trays that are easily cleaned and can be run through heat pressure washers with no seams to trap moisture or materials.

Another object of the invention is to provide a tray that can be interstacked with a simple means to resist lateral shifting.

Another object of the invention is to provide trays that can easily be handled by mechanical handling systems.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit of sacrificing any of the advantages of the invention.

GENERAL DESCRIPTION OF DRAWINGS

DETAILED DESCRIPTION OF DRAWING

Figure 3:
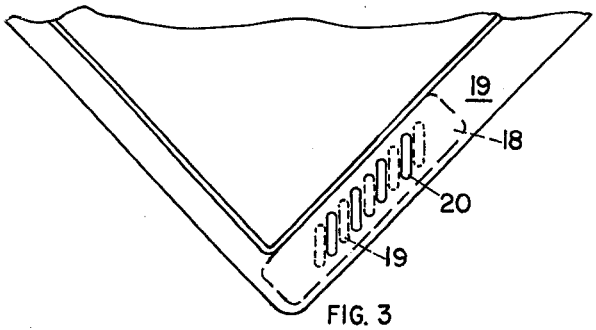
FIG. 3 is a partial top view of the tray.

Now with more particular reference to the drawings. The tray's indicated generally at 10 have a body 11 made up of sides 12 and 13 and ends 14 and 15 and bottom 16 forming an enclosure to receive material and top surface 17 bordering the space between the sides and ends.

Feet 18 are integrally attached to the bottom 16 and extend downwardly therefrom providing a space therebetween for the lugs 23 and 24.

The feet 18 have flat bottom surfaces 22 which have spaced ribs 19 thereon that extend downwardly and provide spaces to receive the lugs 20 which are fixed to the top surface 17 bordering the material receiving space of the tray.

Figure 2:
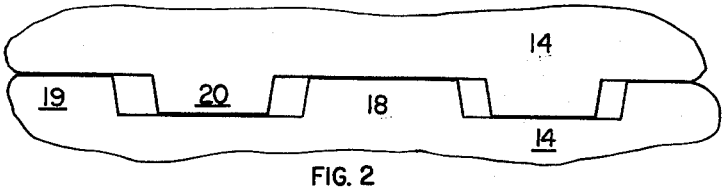
FIG. 2 is an enlarged view of a part of a tray.

The ribs 20 and 21 are shown to be of sightly less length than the width of the feet 18, however, they could extend entirely across the feet. They are shown in FIG. 2 to be disposed at an acute angle to the sides of the tray. This angle is controlled by the length of the tray and the spacing of the ribs at an angle of about 45°, however, they could be, for example, 30° or any other suitable angle.

The ribs 19 and 20 are shown to be spaced from each other a substantially greater distance than the width of the ribs, however, the ribs could be spaced from each other a lesser amount sufficient to provide for enough clearance to account for debris and other foreign matter that might accumulate and also to give a good free working clearance. The spacing should also be such as to provide for both lateral and angular misalignment without comprising the stacking ability and resistance to lateral slipping when stacked.

Figure 6:
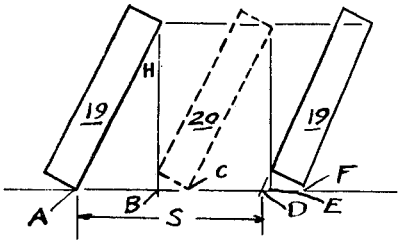
FIG. 6 is a diagram of the spacing of ribs.

Lateral slipping is prevented when the spacings of the lugs is less than (2) × (rib length) × (rib width) × (cos H − sin H × tan H) angle of the lug to a side of the tray. FIG. 6 indicates that when the spacings are less than 2 × (rib length) × (sin H) + (rib width) × (cso H − sin H × tan H) the lateral sliding is prevented.

It will seen that the side and end surfaces of the feet 18 are flush with the sides 12 and ends 14 and all corners are smooth and free from cracks and crevices and sharp corners which would otherwise entrap material being handled.

Figure 1:
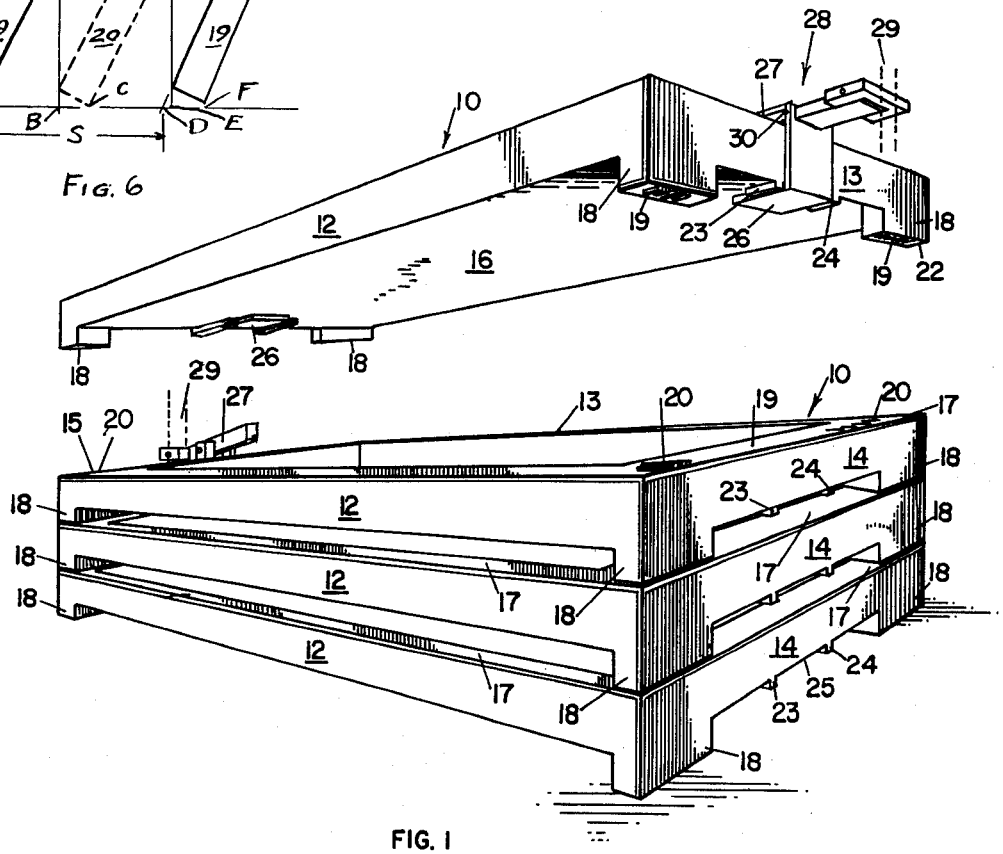
FIG. 1 is an isometric view showing the trays as being stacked by a mechanical handling system.
Figure 4:
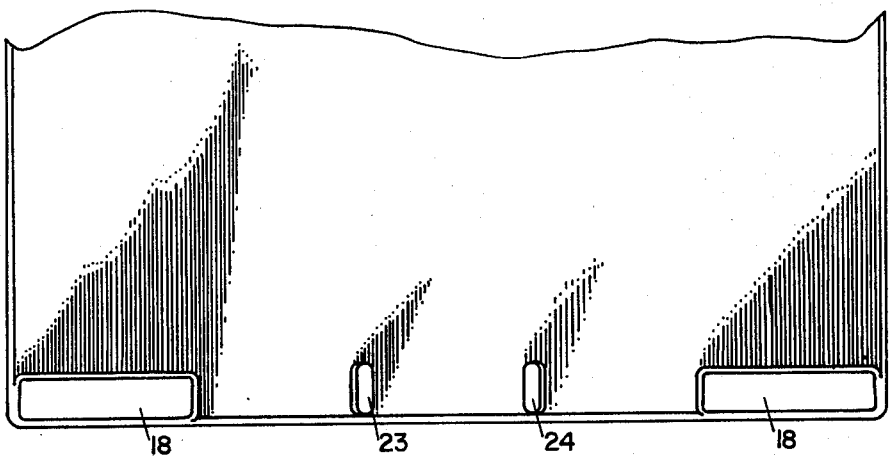
FIG. 4 is a partial bottom view of a tray.
Figure 5:
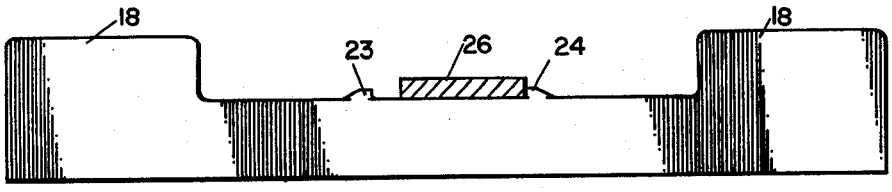
FIG. 5 is an enlarged end view of a tray.

The lugs 23 and 24 are sufficiently spaced from each other a sufficient distance to receive the lower part 26 of the hand 28 which may be attached to the lift mechanism 29 of a type familiar to those skilled in the art for lifting the trays. The L-shaped piece 26 is pivoted to the plate 27 at 30, therefore, when the lifting mechanism 29 is put under tension and moved upwardly, the parts 26 and 27 will swing toward each other and grip the end of the tray. The lugs 23 and 24 will be spaced from each other sufficiently to freely receive the member 26 of the lifting mechanism. Thus, when an upper tray moves to the position shown in the lower part of FIG. 1, the end parts 26 and 27 of the lifting mechanism 28 will be moved away from each other so that they can automatically release the tray for stacking. It will be noted from FIG. 5 that the lugs 23 and 24 have outer surfaces that slope outwardly and upwardly providing a smooth radius, and it will also be noted that the part 26 of the lifting mechanism is considerably narrower than the space between the lugs 23 and 24 so as to provide easy entrance thereof.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A one piece molded tray adapted to be stacked with like trays comprising, a generally rectangular body having sides, ends and a bottom defining an enclosure, said sides and ends having planar top surfaces to the bottom surface, said top and bottom lying in parallel planes, longitudinally and laterally spaced feet having flat bottom surfaces integrally attached to said bottom at the ends thereof and extending downwardly from said bottom providing a space below said tray bottom and between said feet at the sides and ends to receive hands, said feet having flat planar bottom surfaces, spaced downwardly extending ribs on said bottom surfaces of said feet and spaced upwardly extending ribs on said top surface of said ends adapted to receive said spaced ribs on the bottom of the feet of a like tray thereby restraining said trays from lateral shifting, said ribs being spaced from one another sufficiently to allow intermeshing ribs of another like tray, said sides, ends, and bottom of said tray being formed as said smooth planar surfaces, except for said upwardly extending ribs thereby preventing the retaining of foreign matter, said ribs on said bottom surface of said feet and said ribs on said top surface of said sides being inclined toward longitudinal center of said tray and outwardly to prevent lateral, longitudinal and angular misalignment without compromising stacking ability, wherein the side edges of said ribs are disposed at an acute angle to the side edges of said tray, said angle being of a magnitude that a line parallel to a side edge of said tray, passing through a side edge of one said rib adjacent an end thereof will pass through a side edge of the rib adjacent said first mentioned rib at the end of said second mentioned rib adjacent an end thereof.

2. The tray recited in claim 1 wherein laterally spaced downwardly extending lugs attached to said bottom adjacent each end of said tray between said spaced feet, said lugs being disposed on either side of the center of each end of said tray providing a space for receiving the hand of a mechanical tray handling device.

3. The tray recited in claim 2 wherein said top flat surfaces of said tray engage a second part of said device, when said bottom part of said tray is engaged by said first mentioned part of said hand.

4. The tray recited in claim 1 wherein the spacing between said ribs is less than $2L \sin H + L(\cos H - \sin H \cos H)$ when L is the rib length and H is the angle of the rib to a side of the tray.

* * * * *